United States Patent [19]

Olson

[11] 4,393,538

[45] Jul. 19, 1983

[54] SCRUBBER WITH FOAM AND SPRAY SUPPRESSOR

[75] Inventor: Donald L. Olson, Minneapolis, Minn.

[73] Assignee: Tennant Company, Minneapolis, Minn.

[21] Appl. No.: 185,651

[22] Filed: Sep. 9, 1980

Related U.S. Application Data

[63] Continuation-in-part of Ser. No. 72,826, Sep. 6, 1979, abandoned.

[51] Int. Cl.[3] ..... A47L 11/204

[52] U.S. Cl. ..... 15/320; 15/353; 55/178; 55/242; 55/259

[58] Field of Search ..... 15/320, 340, 321, 353; 55/87, 178, 242, 259

[56] References Cited

U.S. PATENT DOCUMENTS

| | | | |
|---|---|---|---|
| 1,763,446 | 11/1929 | Keefer | 15/320 X |
| 2,149,453 | 3/1939 | Longshore et al. | 15/320 |
| 2,923,956 | 2/1960 | Bixler | 15/321 X |
| 2,972,769 | 2/1961 | Keating et al. | 15/321 |
| 3,173,777 | 3/1965 | Tamny | 15/340 X |
| 4,003,724 | 1/1977 | Payne et al. | 55/87 |

*Primary Examiner*—Chris K. Moore

*Attorney, Agent, or Firm*—Merchant, Gould, Smith, Edell, Welter & Schmidt

[57] ABSTRACT

An industrial scrubbing machine is provided including a foam and spray suppressor in the detergent solution recovery system. The foam suppressor decreases the velocity of the detergent solution as it is drawn from the floor back into the apparatus by the squeegee. The decrease in velocity of the detergent solution allows the solution to be redeposited in the scrubbing apparatus with a minimum of agitation, thus suppressing the tendency of the detergent solution to foam and form spray. The apparatus may have a foam filter in the solution recovery tank to assist in controlling foam development and movement. Further, the apparatus may have spray nozzles to apply a mist to break foam that has developed.

19 Claims, 3 Drawing Figures

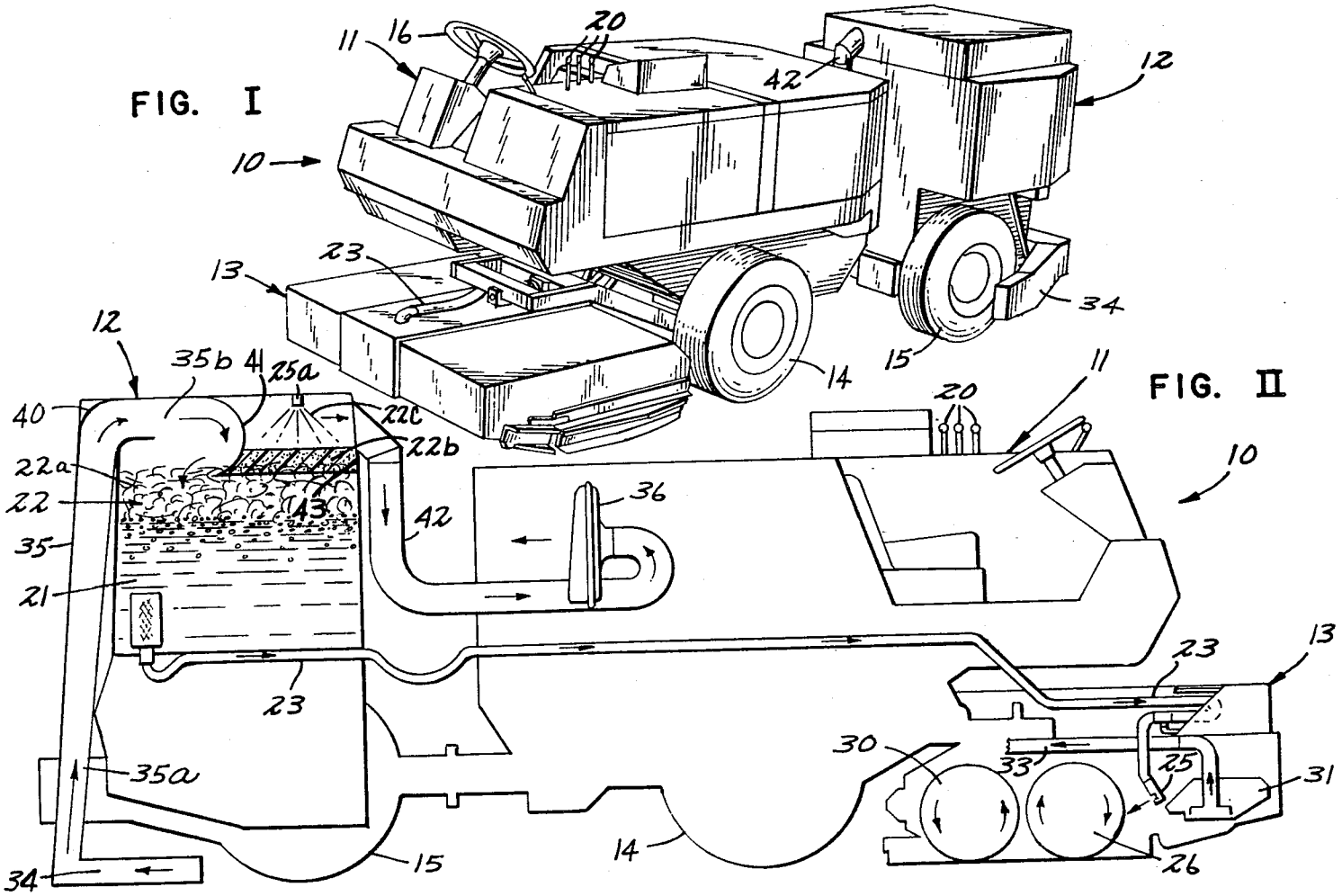
FIG. I
FIG. II
10
11
12
13
14
15
16
20
21
22
22a
22b
22c
23
25
25a
26
30
31
33
34
35
35a
35b
36
40
41
42
43

FIG. III
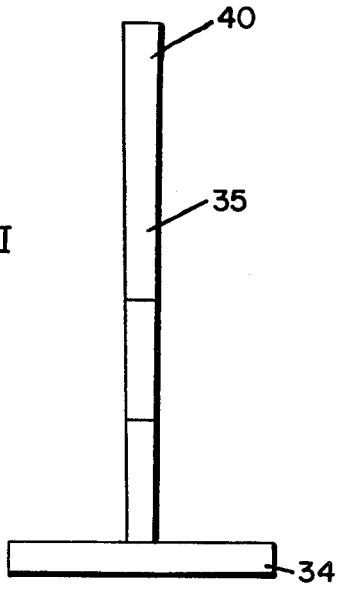

SCRUBBER WITH FOAM AND SPRAY SUPPRESSOR

This application is a continuation-in-part of U.S. patent application Ser. No. 72,826 filed Sept. 6, 1979, and now abandoned.

TECHNICAL FIELD OF THE INVENTION

This invention relates to certain apparatus used to scrub floors and other surfaces in industrial environments. More particularly, it relates to scrubbers including foam suppressing apparatus incorporated into the scrubbing solution recovery system. The foam and spray suppressing apparatus enables the scrubbing solution to be recovered from the scrubbed surface and returned to a recovery tank in the scrubber with a minimum of foaming and spray formation.

BACKGROUND OF THE PRIOR ART

There are many types of industrial scrubbing equipment used to scrub floors and/or other surfaces in various industrial environments. Most of these devices have many features in common. They are generally self-propelled devices containing a reservoir for holding a detergent solution. There is some provision for transferring the detergent solution to the surface to be scrubbed and a brush for working the solution on such surface. Scrubbers generally have a squeegee and vacuum fan system to retrieve the scrubbing solution from the surface after the surface has been scrubbed with the detergent solution and transfer the scrubbing solution to a tank in the body of the scrubber.

A common problem arising in the recovery process is the foaming of the scrubbing solution as it is transferred from the surface to the tank. This foaming is a result of the high recovery velocity of the scrubbing solution, rapid changes in the velocity of the solution and turbulence produced during such changes. A further problem is that the solution impinges on the wall upon entering the tank causing spray to form and causing the solution to flow along the walls of the tank and into the outlet duct. An additional problem is that high velocity air entering the tank, with or without solution, will agitate the surface of the solution in the tank thereby causing foam and spray to form. The high velocity, rapid changes in velocity, turbulence, and the impingement on the wall agitate the scrubbing solution causing foam and spray to develop. Industrial floor scrubbers desirably are compact in design to operate effectively and are highly maneuverable. This need for compactness accentuates the potential problems in foam and spray generation and control. Often detergents used in the cleaning solutions are high foamers. In addition, the soilage that is scrubbed from industrial or commercial plant floors will frequently contain high foaming agents. Illustrative of such agents are drawing compounds and coolant cutting oils used in metal fabrication plants, cleaning compounds used in a wide variety of industries, spilled food products and detergents in food warehouses, leak detectors in tank fabrication, chemical additives in many industrial processes, and the like.

The foaming and spray formation can produce various severe problems. It can reduce drastically the volume available in the tank for the recovered solution. The foam fills the tank and exits through the vacuum fan with the expelled air. When excess foam is present the machine must be stopped, driven to a cleaning station, cleaned out and refilled. The machine may then be sent back out on location to scrub. This is costly in lost time and labor. The foam and spray passing through the fan is dirty and contains many harmful suspended and dissolved materials. This can accelerate corrosion of the fan and other scrubber machine parts exposed to the effluent. The effluent may also corrode and contaminate the products, equipment, and the structures of facilities in which the machine is operated. The effluent is obnoxious to people and in many facilities will contain substances dangerous to health. In such instances the levels of these substances must be closely controlled. Industries such as lead plants, asbestos plants, pesticide plants, and warehouses, and chemical plants are illustrations of instances where toxic substances must be controlled. It therefore is important that the spray and foam formation be controlled and not allowed to be expelled into the atmosphere with the air from industrial scrubbers.

The foam and spray formation problem is increased as the level of the recovered solution approaches the upper portion of the tank near the vacuum duct leading to the fan. This is a major concern with typical one or two tank recycling industrial floor scrubbers. Such recycling systems operate with full tanks for most of their scrubbing operation. Illustrative of this type of scrubber machine is that described in U.S. Pat. No. 3,753,777 (Thomsen et al) and U.S. patent application Ser. No. 916,929 filed June 19, 1978.

It has been found highly advantageous in the present invention to provide a scrubber with apparatus for recovering the scrubbing solution under conditions which suppress the formation of foam and spray.

BRIEF SUMMARY OF THE INVENTION

This invention is directed to scrubbing machines. The present scrubbing macine has a body supported on a plurality of wheels. The body may carry one or more scrubbing solution tanks and suitable piping for applying scrubbing solution to the floor or other surface. The scrubbing machine may also have one or more brushes for working the solution on the surface to loosen soilage. The scrubbing machine is provided with a recovery system including a vacuum operated squeegee to pick up solution from the surface. An improvement is incorporated into the recovery system of the scrubbing machine which uniformly lessens the velocity of the detergent solution as the solution travels along the recovery duct extending from the squeegee to the recovery tank. The velocity is decreased in such a manner as to minimize the agitation of the detergent solution. The recovery tank head space is also sized to minimize foaming. The present machine may include provision to spray water on the foam head to further reduce foam accumulation. The head space may have a foam filter to reduce foam accumulation and prevent escape of the foam into the fan and air discharge outlet.

During normal operation, the scrubbing machine transfers the detergent solution from a tank carried in the scrubber to the surface to be scrubbed. A scrubbing portion of the machine, such as a brush, works the detergent solution on the surface thereby loosening soilage. This dirty scrubbing solution is recovered by the squeegee and retrieval portion of the scrubbing machine. The dirty scrubbing solution is drawn up and into the scrubbing machine by a vacuum to be deposited in a tank. During the transfer of the solution from the surface to the tank, the velocity of the solution is uniformly decreased by passage through a recovery duct having a uniformly increasing cross-sectional area. Since there is a uniform decrease in velocity, turbulence is kept to a minimum, the agitation of the recovered scrubbing solution is kept at a minimum, the impingement against the tank walls and the tendency of the solution to form foam and spray is thus minimized. Reducing the entrance velocity into the tank also minimizes erosion of tank walls due to impingement of sand and other abrasive materials. With respect to minimizing foam and spray formation it has been found that the solution velocity at entrance into the recovery tank is very important. The present invention provides control of solution velocity thus reducing foam and spray formation.

BRIEF DESCRIPTION OF THE DRAWINGS OF AN EXEMPLARY MODEL

FIG. I is a perspective view of a scrubbing machine according to the present invention; and FIG. II is a diagrammatic view of the present scrubbing apparatus showing the path of the detergent solution through the scrubbing operation.

FIG. III is a rear view of the duct of the present scrubbing apparatus.

DETAILED DESCRIPTION OF THE INVENTION

The overall construction of one embodiment of the present scrubbing machine is shown in FIGS. I and II. A scrubbing machine 10 is comprised of a power and control portion 11, a solution containing portion 12, and a scrubbing portion 13. The scrubbing machine is illustrated having an articulated body. Mobility is provided through wheels 14 rotatably affixed to portion 11, and wheels 15 rotatably affixed to portion 12. A motor or engine (not shown) rotatably drives at least one of the wheels such as wheel 14. Operational control of the scrubbing apparatus 10 is provided by steering wheel 16 and control levers 20.

The flow of the detergent solution through the scrubbing machine 10 can be best understood with reference to FIG. II. The detergent solution 21 is contained in solution tank 22 which is carried in portion 12 of scrubber 10. Solution delivery hose 23 carries detergent solution 21 from tank 22 to the scrubbing portion 13 where it connects to outlet nozzle 25. The solution is released from nozzle 25 onto the surface to be scrubbed.

The detergent solution 21 is worked on the surface by rotating brushes 26 and 30, thereby loosening soilage. Brush 26 may rotate in a clockwise direction which brush 30 may rotate in a counterclockwise direction. The rotation of brushes 26 and 30 is effective to loosen soilage and to pick up some small debris lying on the surface and deposit the debris in the trough 31. The brush rotation also causes some of the detergent solution 21 to be deposited in debris trough 31. Any detergent solution 21 that is deposited in debris trough 31 may be transferred back to tank 22 by means of vacuum return hose 33. The present scrubbing machine is shown as a single tank machine wherein one tank 22 serves both as a solution supply tank and as a recovery tank. It is to be recognized that a two tank system may alternatively be used with one tank containing solution for application to the floor surface and the other tank for recovery of scrubbing solution.

Detergent solution 21 remaining on the surface is accumulated at the rear of scrubbing apparatus 10 by means of a squeegee 34 located at the rear of solution containing portion 12. The air velocity in the plenum and manifold of the squeegee must be high enough to provide a substantially dry surface immediately behind the scrubber. Desirably the air velocity is adequate to lift scrubbing solution from irregularities such as holes, cracks, joints and depressions in the scrubbed surface. It is desirable that the solution delivery nozzle 25 and vacuum squeegee be adapted to provide a ratio of less than 0.013, preferably less than 0.008, gallons of solution per cubic foot of air. This can be accomplished by control of flow rates and vacuum. In some scrubbing machines the air velocity in the squeegee 34 and duct 36 may be sufficient to convey sand, metal debris and the like from the scrubbed surface to the recovery tank. The detergent solution 21 which is collected by squeegee 34 is drawn up a recovery duct 35 and into tank 22 by means of a vacuum created by high volume vacuum fan 36. It is hghly desirable that only air passes through fan 36.

The fan 36 provides sufficient vacuum to effectively collect the scrubbing solution in the squeegee 34 and lift the solution and possibly some debris through the duct 35 into tank 22. The fan 36 provides an air velocity sufficient to pick up the dirty scrubbing solution from the floor and transfer such solution to the recovery tank. This air velocity may typically be at least 60 feet per second at the entrance into duct 35. Such velocity will generally be in the range of 125 to 250 feet per second at the entrance of duct 35. The characteristics of the present recovery system are described with regard to "air velocity through the duct 35 without solution in the system" rather than with regard to the velocity of the solution in actual size. This is because the veocity of the solution and air mixture in actual use may vary somewhat depending on the amount of solution and debris picked up with the air, the size of the ducts and the fan chracteristics.

The duct 35 (FIGS. II and III) desirably increases in cross sectional area at a substantially uniform rate from entrance to exit which facilitates recovery of the solution with minimum foaming and spray formation. The entrance area to exit area ratio may be such that the exit air velocity from duct 35 is forty feet per second, preferably thirty feet per second or less. This entrance area to exit area ratio may be at least about 1 to 5. The preferred ratio with an entrance velocity of 200 feet per second is in the range of about 1:5 to 1:20. This provides for a reduction in solution velocity in a uniform manner to minimize turbulence, foaming and spray formation. The air velocity at the entrance **35*a* of recovery hose 35 will be typically at least 200 feet per second. The air velocity at the exit 35*b* in tank 22 with a 1:5 ratio is about forty feet per second or less. A greater velocity at this point may result in spray formation and foaming. Such spray formation may also result in solution entering fan 36. The preferred velocity at the exit 35*b* is in the range of about 15 to 30 feet per second. Of course, it is desirable for the velocity to be as low as practically possible at exit 35*b***. The practical minimum velocity is felt to be about 10 feet per second.

The duct 35 (FIGS. II and III) may be of any desired cross sectional shape such as circular, ovular, triangular, square, trapezoidal, rectangular or other polygonal shape. The cross sectional area may be increased by increasing the cross sectional dimensions in one or more directions. For example, if the hose 35 is circular in cross section, the diameter may uniformly increase along the length of duct 35 to provide the aforementioned ratio of entrance area to exit area. If the duct 35 is rectangular in cross section, all walls may diverge equally or unequally or alternatively one, two or three walls may diverge while the other wall or walls remain straight. The walls may diverge from one another at a total divergent angle between opposite walls, including averaging all walls, of up to about 20°, preferably between about 8° and 15°. Although it is desirable that the divergent angle be constant throughout the duct 35 practical construction may necessitate some deviation from this ideal. The increase in duct cross-sectional area is gradual enough to maintain turbulence in the duct as low as possible, since turbulence also contributes to the formation of foam and spray.

The duct 35 may be substantially straight throughout the length thereof or may be curvelinear such as in a spiral shape in order to provide adequate length in duct 35 for reducing the velocity of the solution. One preferred arrangement of the squeegee and recovery duct is illustrated in FIG. II. As the solution 21 is drawn up recovery duct 35, it passes through a cuvilinear or arcuate portion of duct 35 which may consist of a gentle 90 degree elbow 40. The flow of scrubbing solution is then directed into an arcuate baffle 41. The baffle 41 may change the direction of flow an additional 180 degrees. The direction of the incoming flow may be parallel with the exiting air stream at duct 42 and solution surface 21 and the flow and airstream are preferably in directly opposite directions. Circular elbow 40 and baffle 41 change the direction of the flow of the solution 21 and thus further assisting in avoiding impingement on wall 43 and subsequent entrance of solution 21 into duct 42 and fan 36. The solution 21 then falls gently into tank 22. The recovered scrubbing solution contains in tank 22 may have the suspended soilage at least partially removed such as by filtering and recycled back to the scrubbing section 13.

It has been found that the amount of recovery tank head space or plenum space **22*a* above the solution has a substantial impact on the amount of foaming that takes place in the recovery tank. In the present inventon, the plenum space 22 may be sufficiently sized so that the number of air changes in the plenum space 22*a*** is sixty or fewer per minute, more desirably forty or fewer.

The accumulation of foam in the plenum space **22*a* may be reduced by providing a foam filler 22*b* in the plenum space 22*a*. There should be sufficient space 22*c* above the foam filter to avoid interference with the air flow passing through the tank 22. The tank 22 has suitable support for the foam filter 22*b* such as an angle support around the periphery of the tank and/or a secured grid system. The foam filter 22*b* is desirably spaced upwardly from the upper surface of the solution 21. The lower surface of the foam filter 22*b* may be located with two-thirds of what would be the unfiltered foam head therebeneath. The foam filter 22*b* overlies the solution in such a manner as to block the rise of the foam in the tank and prevent direct contact of the air currents in plenum space 22*a* with the foam head. This arrangement also prevents creation of additional foam due to agitation at the upper surface of the solution and prevents carrying of foam by the air currents going to the fan 36. Such locating of the foam filter provides for good drainage of the foam head. The foam filter 22*b* may be a metal wool or a knitted wire mesh. Other suitable materials include plastic wool with imbedded abrasive particles or open celled foam sponge. The foam filter 22*b*** may be at least one inch in thickness and is preferably about two inches in thickness.

The foam accumulation may be further reduced by periodically applying a fine mist or spray of fresh water to the plenum space **22*a* or to the upper surface of the foam filter 22*b*. The water dilutes the solution forming the foam and the bubbles rapidly break. Suitable nozzles 25*a* may be provided in tank 22** to apply the fine mist. The apparatus may have an auxiliary tank for carrying fresh water or the apparatus may be adapted for connection to an external water line.

In operation, detergent solution 21 is transferred from solution tank 22 to scrubbing portion 13 through solution delivery hose 23. The detergent solution reaches the surface being scrubbed through outlet nozzle 25. The scrubbing action of brushes 26 and 30 causes some of the solution to be deposited in debris trough 31. This solution will be transferred directly back to tank 22 by means of return hose 33. The remainder of the solution will be collected by squeegee 34.

High volume vacuum fan 36 causes scrubbing solution 21 to be drawn rapidly up recovery duct 35. The solution slows as it passes along duct 35 and enters tank 22 at a velocity of 40 feet per second or less. When the detergent solution 21 encounters baffle 41, it will fall with a minimum of agitation into tank 22. The decrease in velocity allows the detergent solution 21 to fall gently into tank 22 effectively suppressing the tendency to foam and form spray associated with high speed reentry.

What is claimed:

1. A scrubbing machine comprising:

a body;

wheels rotatably affixed to said body;

tank means for containing scrubbing solution, said tank means comprising a single recovery tank;

means for conveying said solution from said tank means to the surface to be scrubbed;

means for working the solution on the surface;

vacuum squeegee means for recovering said solution from the scrubbed surface;

means for conveying said solution from said squeegee means to said tank means; said conveying means including a vacuum fan and duct means, said vacuum fan providing sufficiently high velocity to pick up said solution from the surface, said velocity being sufficiently great that substantial foaming would occur in said tank means if said velocity were maintained throughout said duct means; said duct means having an entrance cross section area to an exit cross sectional area ratio sufficient to substantially reduce the necessary high velocity of the solution at the squeegee means to a critical lower velocity which minimizes foaming and spraying, wherein at least a portion of said duct means has a substantially uniformly increasing cross sectional area whereby said solution velocity is reduced sufficiently to avoid development of foam and spray as said recovered solution is conveyed to said tank means.

2. A scrubbing machine as defined in claim 1 wherein said duct means portion of increasing cross sectional area is of sufficient length to reduce the solution velocity to 40 feet per second or less.

3. A scrubbing machine as defined in claim 2 wherein said duct means has an upper arcuate portion for decreasing the velocity of said solution as said solution follows an arcuate path.

4. A scrubbing machine as defined in claim 1 wherein said ratio is in the range of between 1:5 and 1:20.

5. A scrubbing apparatus comprising:

a body;

wheels rotatably affixed to said body;

means for containing aqueous detergent solution;

means for conveying said aqueous detergent solution to the surface to be cleaned;

means for scrubbing the surface to be cleaned with said aqueous detergent solution;

means for recovering said aqueous detergent solution from the clean surface;

said recovering means including duct means for conveying said recovered aqueous detergent solution from said recovery means to said containing means, said duct means serving to decrease the velocity of said solution from an inlet velocity of at least 200 feet per second to thirty feet per second or less upon entering the containing means thereby suppressing foam and spray as said recovered aqueous detergent solution is conveyed into said containing means.

6. A scrubbing apparatus as defined in claim 5 wherein said recovery means comprises a squeegee which collects said recovered aqueous detergent solution and a high volume vacuum fan which causes said recovered aqueous detergent solution to be drawn along said duct means.

7. A scrubbing apparatus as defined in claim 5 wherein said duct means for decreasing the velocity comprises duct means has a uniformly increasing cross sectional area.

8. A scrubbing apparatus as defined in claim 7 wherein said duct means includes a duct portion which defines an arcuate path.

9. The scrubbing apparatus of claim 5 wherein said containing means comprise a single tank.

10. The scrubbing apparatus of claim 5 wherein said containing means comprise a pair of tanks, one of said tanks being a tank for containing solution for application to the surface, the other of said tanks being for containing solution recovered from said surface.

11. The scrubbing apparatus of claim 10 wherein said recovery tank has a plenum space size and a fan volume flow rate to provide air changes in said plenum space of sixty or fewer per minute during operation.

12. The scrubbing apparatus of claim 11 wherein said plenum space size and fan volume flow rate are sufficient to provide air changes in said plenum space of forth or fewer per minute during operation.

13. The scrubbing apparatus of claim 5 wherein said containing means has a ratio of plenum space size to fan volume flow rate sufficient to provide air changes in said containing means of sixty or fewer per minute during operation.

14. The scrubbing apparatus of claim 13 wherein said ratio is sufficient to provide air changes in said plenum of forty or fewer per minute during operation.

15. The scrubbing apparatus of claim 13 wherein a foam filter is disposed in said plenum space.

16. The scrubbing apparatus of claim 15 wherein said foam filter comprises a member selected from the group consisting of metal wool and knitted wire mesh.

17. The scrubbing apparatus of claim 11 wherein said apparatus includes means for spraying water into the plenum space.

18. The scrubbing apparatus of claim 15 wherein said apparatus includes means for spraying water into the plenum space.

19. A scrubbing machine comprising:

a body;

wheels rotatably affixed to said body;

tank means for containing scrubbing solution, said tank means including a plenum space;

means for conveying said solution from said tank means to the surface to be scrubbed;

means for working the solution on the surface;

vacuum squeegee means for recovering said solution from the scrubbed surface;

means for conveying said solution from said squeegee means to said tank means;

said tank means having foam suppressing means including means for spraying a fine mist into said plenum space in said tank means.

* * * * *

UNITED STATES PATENT AND TRADEMARK OFFICE

CERTIFICATE OF CORRECTION

PATENT NO. : 4,393,538

DATED : July 19, 1983

INVENTOR(S) : Donald L. Olson

It is certified that error appears in the above-identified patent and that said Letters Patent is hereby corrected as shown below:

Column 2, line 37, "macine" should be --machine--.

Column 3, line 51, "which" should be --while--.

Column 4, line 19, "hghly" should be --highly--.

Column 4, line 34, "size" should be --use--.

Column 5, line 22, "cuvilinear" should be --curvilinear--.

Column 5, line 42, "inventon" should be --invention--.

Column 5, line 47, "filler" should be --filter--.

Column 8, line 8, "forth" should be --forty--.

Claim 7, line 3, delete "has" and insert therefor --having--.

Signed and Sealed this

*Twenty-first* Day of *February 1984*

[SEAL]

*Attest:*

GERALD J. MOSSINGHOFF

*Attesting Officer*

*Commissioner of Patents and Trademarks*